United States Patent [19]

Washizuka et al.

[11] Patent Number: 4,858,125

[45] Date of Patent: Aug. 15, 1989

[54] ELECTRONIC CONE WITH ENVIRONMENTAL AND HUMAN BODY CONDITION SENSORS AND ALARM FOR INDICATING EXISTENCE OF UNDESIRABLE CONDITIONS

[75] Inventors: Isamu Washizuka, Soraku; Shinji Tsugei; Tomohiro Inoue, both of Nara, all of Japan

[73] Assignee: Sharp Kabushiki Kaisha, Osaka, Japan

[21] Appl. No.: 602,170

[22] Filed: Apr. 19, 1984

[30] Foreign Application Priority Data

| | | | |
|---|---|---|---|
| Apr. 26, 1983 | [JP] | Japan | 58-64561[U] |
| Apr. 26, 1983 | [JP] | Japan | 58-64560[U] |
| May 19, 1983 | [JP] | Japan | 58-75408[U] |
| May 19, 1983 | [JP] | Japan | 58-75407[U] |
| Jun. 1, 1983 | [JP] | Japan | 58-84392[U] |

[51] Int. Cl.[4] ..... A45B 3/00

[52] U.S. Cl. ..... 364/413.01; 364/413.03; 135/65

[58] Field of Search ..... 364/413, 413.01, 413.03; 128/689; 135/65, DIG. 11; 368/10, 11, 12

[56] References Cited

U.S. PATENT DOCUMENTS

| | | | |
|---|---|---|---|
| 3,546,467 | 12/1970 | Benjamin, Jr. et al. | 135/65 X |
| 3,570,239 | 3/1971 | Charles | 368/11 |
| 3,906,971 | 9/1975 | Burnstine | 135/65 |
| 4,164,937 | 8/1979 | Spencer | 128/666 |
| 4,189,765 | 2/1980 | Kotalik et al. | 364/900 X |
| 4,236,236 | 11/1980 | Jaunin | 368/11 |
| 4,280,204 | 7/1981 | Elchinger | 135/DIG. 11 X |
| 4,297,884 | 11/1981 | Leveque et al. | 73/579 |
| 4,314,143 | 2/1982 | Bilstad et al. | 219/497 |
| 4,352,059 | 9/1982 | Suh et al. | 324/61 R |
| 4,403,215 | 9/1983 | Hofmann et al. | 340/573 |
| 4,462,930 | 7/1984 | Suzuki et al. | 252/519 |
| 4,466,439 | 8/1984 | Moore | 128/402 |
| 4,493,565 | 1/1985 | Saka | 374/185 |

FOREIGN PATENT DOCUMENTS

| | | | |
|---|---|---|---|
| 0625709 | 10/1978 | U.S.S.R. | 135/DIG. 11 |
| 2052050 | 1/1981 | United Kingdom | 128/689 |

OTHER PUBLICATIONS

Bacon, S. W., "New Ultrasonic Radar for the Blind", *Popular Electronics*, vol. 20, No. 1, Jan. 1964, 49 and 104.

*Primary Examiner*—Clark A. Jablon

*Attorney, Agent, or Firm*—Birch, Stewart, Kolasch & Birch

[57] ABSTRACT

An electronic cane having a grip and a stick contains, inside of the grip, sensors for sensing physical parameters of the surrounding environment and of the user of the cane. Predetermined maximum and minimum values of the parameters are programmed and an alarm is activated if a parameter is outside of the range. The circuitry for performing these functions is in a retractable case. A panic button is also provided for.

5 Claims, 8 Drawing Sheets

ELECTRONIC CONE WITH ENVIRONMENTAL AND HUMAN BODY CONDITION SENSORS AND ALARM FOR INDICATING EXISTENCE OF UNDESIRABLE CONDITIONS

BACKGROUND OF THE INVENTION

The present invention relates to an electronic grip for a walking cane and more particularly, to an electronic grip for sensing body conditions or environmental circumstances.

Conventionally, it is difficult to easily measure physical body conditions because any measurement device must be attached to the body, resulting in difficulting in handling.

Further, conventionally, physically handicapped persons and senior citizens did not freely go out because the environment is unsuitable for them. As a result, they could not adapt themselves to the surrounding environment.

When the disabled person or the senior citizen goes out, it is usual to carry a cane for safety. However, the conventional cane cannot inform the user of the presence or absence of an obstruction and the physical condition of his body, so that he cannot freely go into the environment and the sphere of activity is decreased.

SUMMARY OF THE INVENTION

In view of the above disadvantages, it is an object of the present invention to provide an electronic cane which senses body conditions or environmental circumstances.

It is another object of the present invention to provide an electronic cane comprising an electronic grip which senses body conditions or environmental circumstances.

It is still another object of the present invention to provide an electronic grip for sensing the human body condition, the presence or absence of an obstruction, the surrounding condition or the like.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

According to an embodiment of the present invention, an electronic cane having a grip and a stick comprises sensor means for sensing information, judge means response to said sensor means for judging a range of said information, and output means response to the output of the judge means for alarming or informing.

The grip accommodates an electronic apparatus comprising the sensor means, the judge means, and the output means, and the electronic apparatus is stored in the grip and is projected from the grip during use.

The sensor means is a sensor for sensing a body condition or the surrounding environmental conditions. For example, the sensor is selected from the group consisting of a temperature sensor, a humidity sensor, a blood pressure sensor, a pulse sensor, a touch sensor, an image sensor, a sensor using supersonic waves, and a sensor using infrared rays.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
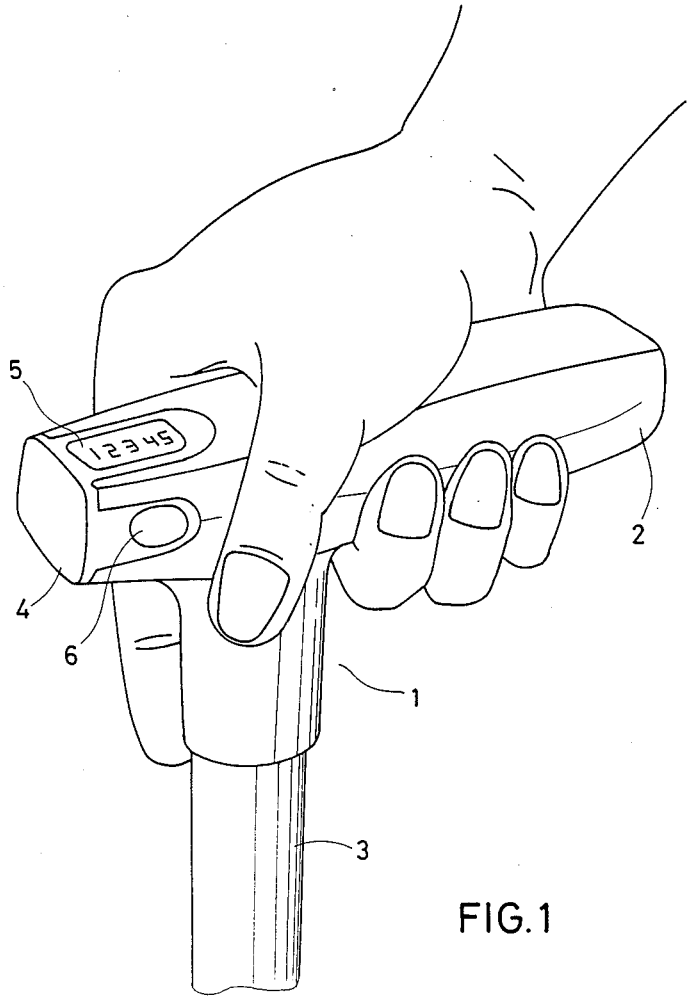
FIG. 1 shows a perspective view of an electronic cane comprising an electronic grip according to a first embodiment of the present invention.

FIG. 1 shows a perspective view of an electronic cane comprising an electronic grip according to a first embodiment of the present invention.

As FIG. 1 shows, an electronic cane 1 comprises an electronic grip 2 including an electronic apparatus 4 for outputting various information, a supporter (stick) 3, a display 5 for displaying information from the electronic apparatus 4, and a push button 6. The grip 2 is handled by the user, and is formed in a T shape.

Figure 8:
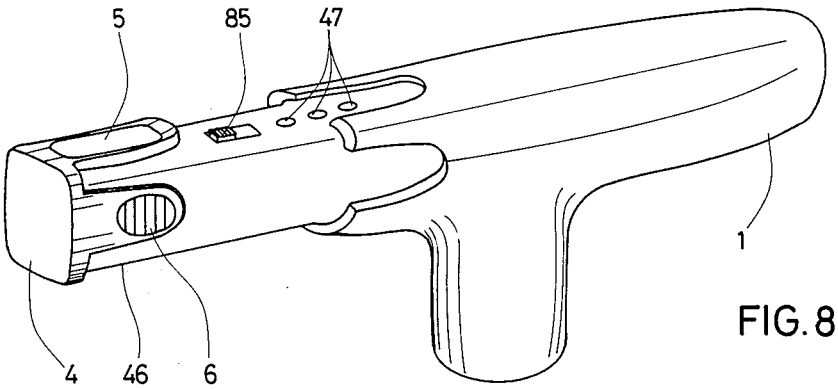
FIGS. 8 and 9 show perspective views of the construction of the grip according to a third embodiment of the present invention.

When the push button 6 is pressed, the electronic apparatus 4 is projected from the electronic grip 2 (as shown in FIG. 8). The electronic apparatus 4 is usually stored in the electronic grip 2.

Figure 2:
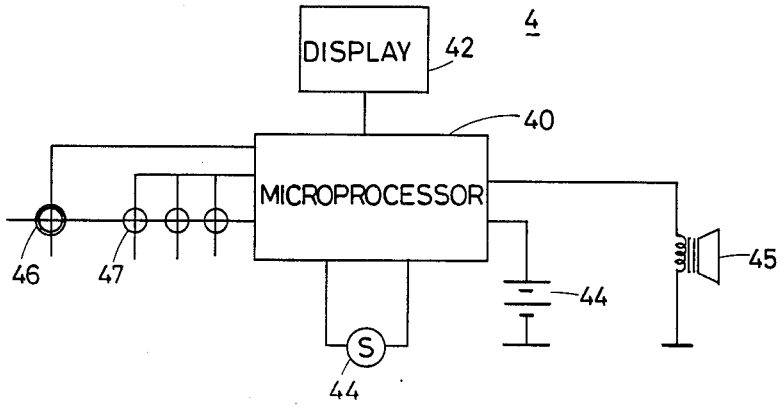
FIG. 2 shows a block diagram of an electronic apparatus of the electronic cane of FIG. 1.
Figure 3:
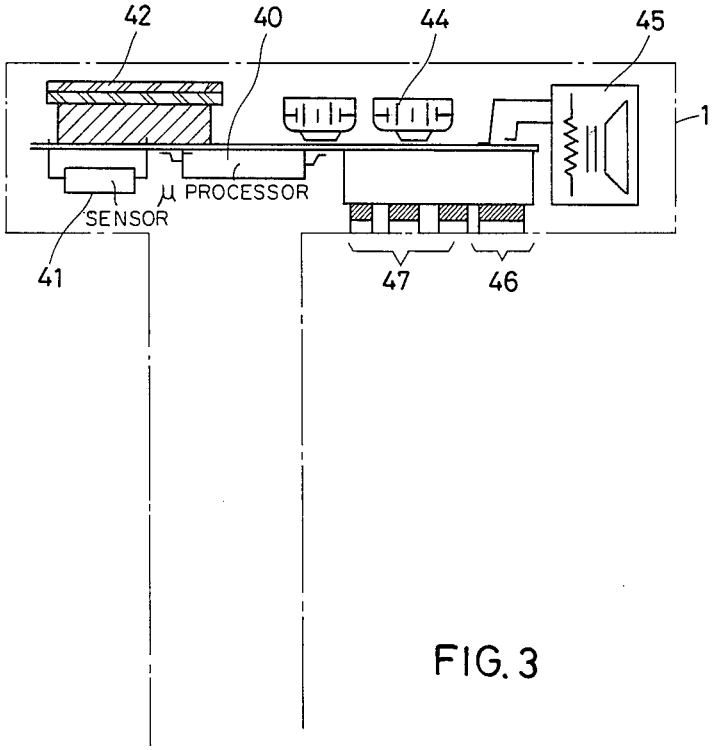
FIG. 3 shows a sectional view of the electronic grip of an electronic cane of FIG. 1.

FIG. 2 shows a block diagram of an electronic apparatus of the electronic cane of FIG. 1. FIG. 3 shows a sectional view of the electronic grip of an electronic cane of FIG. 1.

With reference to FIGS. 2 and 3, the electronic apparatus 4 comprises a microprocessor 40 including a ROM, a RAM, a CPU or the like, a sensor means 41 for sensing human body conditions such as a blood pressure, pulse, etc., or the surrounding environmental conditions such as temperature, humidity, the presence or absence of an obstruction, a display 42 such as a liquid crystal display, data set keys 47, an alarm key 46, a power source 44, and a speaker 45.

The display 42 is provided for displaying information from the sensor means or the mciroprocessor 40. The data set keys 47 are operated to input a maximum and minimum of a set value for alarming or informing of an abnormal condition outside the range of values from the speaker 45. When an alarm is desired to be outputted, after the electronic apparatus 4 is projected by pressing the push button 6, the alarm key 46 is pressed to output the alarm. Also, the alarm may be audibly outputted.

Figure 4:
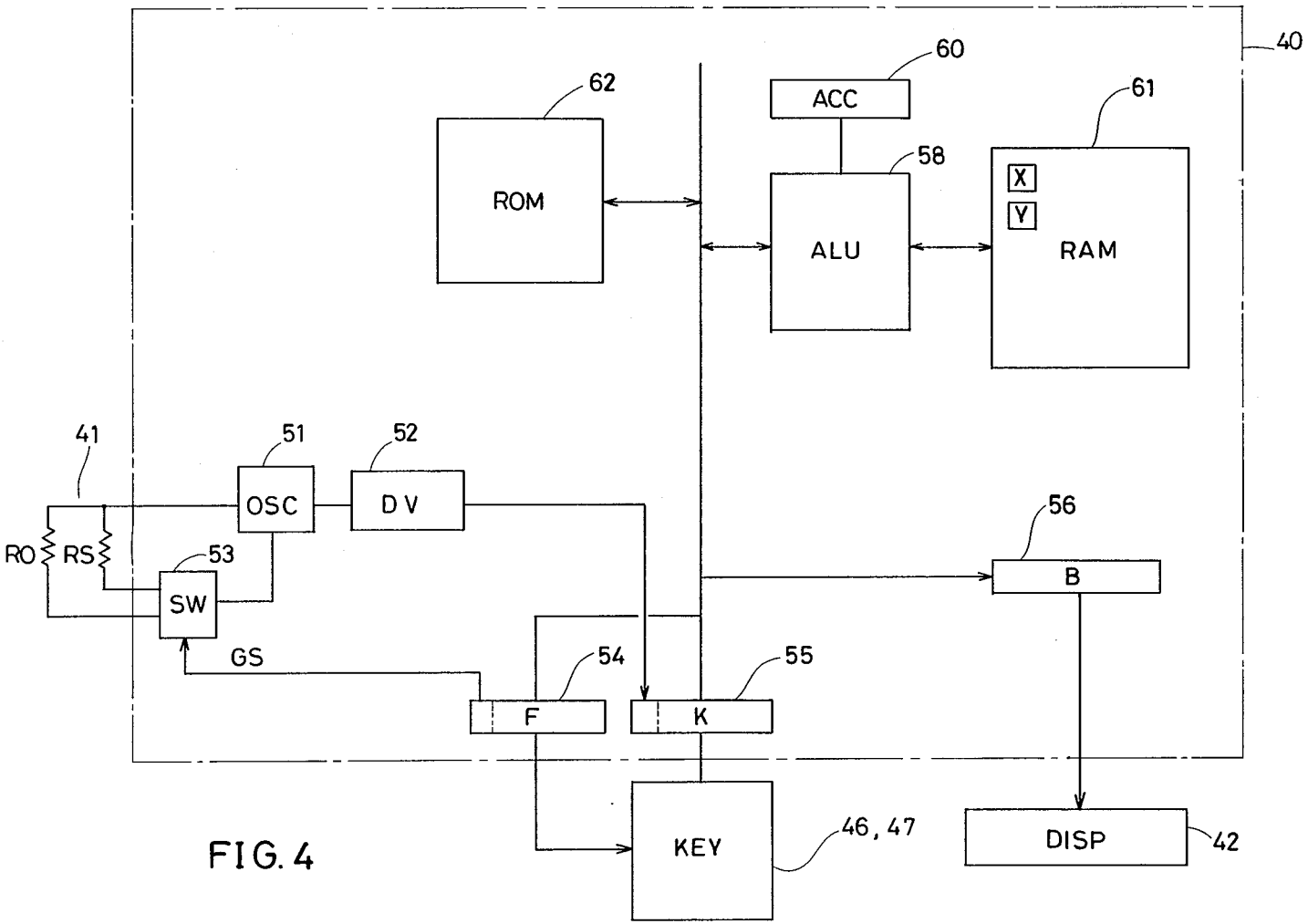
FIG. 4 shows a block diagram of the electronic apparatus stored in the electronic grip according to the first embodiment of the present invention when the sensor means is a temperature sensor.

FIG. 4 shows a block diagram of the electronic apparatus stored in the electronic grip according to the first embodiment of the present invention when the sensor means 41 is a temperature sensor means. As the resistance, in the temperature sensor means 41 is varied according to the surrounding temperature, the temperature sensor means 41 can detect the surrounding temperature.

Figure 5:
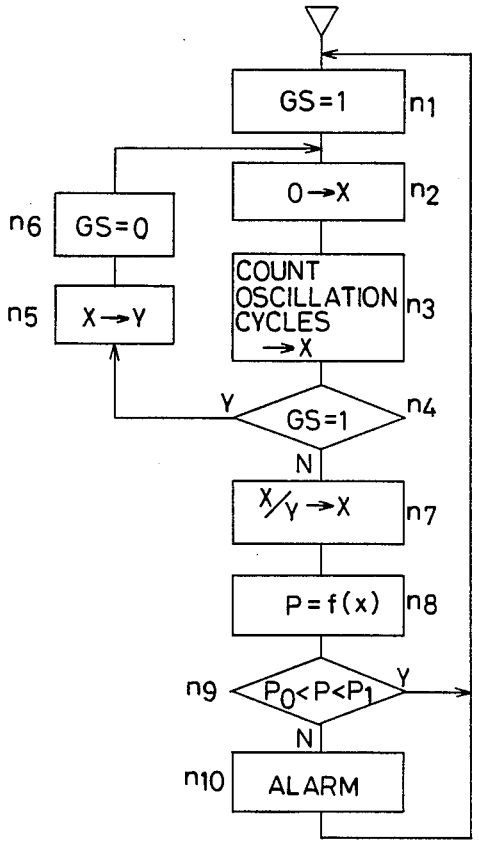
FIG. 5 shows a flow chart explaining the operation of the temperature sensor means of the electronic apparatus stored in the electronic grip according to the first embodiment of the present invention.

FIG. 5 shows a flow chart explaining the operation of the temperature sensor means 41 of the electronic apparatus stored in the electronic grip according to the present invention.

The temperature sensor means 41 comprises a reference resistor R0, a thermistor $R_S$, a switch 53, an oscillator 51, and a frequency divider 52. The microprocessor 40 may include the switch 53, the oscillator 51, and the frequency divider 52.

Further, the microprocessor 40 may include a voice synthesizer circuit for audibly outputting information from the speaker 45.

With reference to FIG. 4, either the reference resistor R0 or the thermistor RS is connected to the oscillator 51 by switching the switch 53. The switch 53 is switched by receiving a gate signal GS from a buffer 54. For example, when GS=1 (High), the reference resistor R0 is connected to the oscillator 51, and when GS=0 (Low), the thermistor RS is connected to the oscillator 51.

The oscillator 51 is oscillated when connecting with the resistor R0 or the thermistor RS. The output of the oscillator 51 is divided by the frequency divider 52. The most significant bit of a buffer 55 is reset or set in response to the output of the frequency divider 52. An X register in the RAM 61 counts at a predetermined period by using the change from 1 (set) to 0 (reset) in order to count the cycles of the output signal of the divider 52. The ratio (RS/RO) of the oscillation frequencies (or the oscillation cycles) between the contents of resistor R0 and those of the thermistor RS is calculated by the count numbers counted by the X register. The surrounding temperature is calculated by the functional calculation based on the ratio of the oscillation frequency. The functional calculation is stored in the ROM 62. The functional calculation of the temperature sensor means and the temperature sensor means are disclosed in the U.S. Patent Application Ser. No. 400,265, now U.S. Pat. No. 4,493,565, by Masakazu SAKA, entitled "THERMOMETRY DEVICE", filed on July 21, 1982, the contents of which are incorporated herein by reference.

The buffer 54 outputs key strobe signals and the gate signal GS. Key signals and the output of the frequency divider 52 are inputted into the input buffer 55.

Information from the temperature sensor means 41, keys 47, or a memory or the like are displayed on the display 42 via a display signal output buffer 56.

An accumulator is designated by 60, and an arithmetic logic unit is designated by 58.

With reference to FIG. 5, the operation of the temperature sensor means 41 will be described as follows.

First, the maximum P1 degrees C. and the minimum P0 degrees C. of a set value are inputted by the keys 47.

The buffer 54 outputs a gate signal GS=1, and the reference resistor R0 is connected to the oscillator 51 by switching the switch 53 in response to the gate signal GS=1. (Step n1). Then, the register is cleared (Step n2). The oscillator 51 is oscillated, and the output of the oscillator 51 is divided by the frequency divider 52. The output of the divider 52 is inputted in the input buffer 55, and the most significant bit of the input buffer 55 is set or reset in response to the output of the divider 52. The X register in the RAM 61 counts at the predetermined period by using the change from 1 (set) to 0 (reset) in order to count the cycles of the output signal from the divider 52 (Step n3). And then, because GS=1 (step n4), the count numbers of the X register are transferred into the Y register (Step n5). Next, the buffer 54 outputs the gate signal GS=0 (Step n6). After the X register is cleared (Step n2), the thermistor RS is connected to the oscillator 51, and the oscillator 51 is oscillated. The output of the oscillator 51 is divided by the frequency divider 52. The output of the frequency divider 52 is inputted into the buffer 55. The most significant bit of the buffer 55 is set or reset in response to the output of the frequency divider 52. The register in the RAM 61 counts at the predetermined period by using the change from 1 (set) to 0 (reset) in order to count the cycle of the output signal from the frequency divider 52 (Step n3).

The ratio (RS/RO) of the oscillation frequencies (or the oscillation cycles) between the contents of the resistor RO and those of the thermistor RS is calculated by using the count numbers stored in the X register and in the Y register (step n7). The ratio of the oscillation frequencies (or the oscillation cycles) is stored in the X register.

The surrounding temperature P is calculated by the functional calculation based on the ratio of the oscillation frequencies (or the oscillation cycles).

The functional calculation is applied by a formula in a table stored in the ROM 62.

The step n9 is executed to detect whether the temperature of the surrounding condition is present between the maximum P1 degrees C. and the minimum P0 degrees C. of the set value stored in the RAM 61 by the keys 47.

If not, the alarm is outputted from the speaker (step n10).

In the above embodiment of the present invention, the surrounding temperature can be measured. if the temperature sensor 41 is provided adjacent a grip handled by the user, the sensor 41 detects whether the user leaves the grip by detecting the decrease of the temperature.

Figure 6:
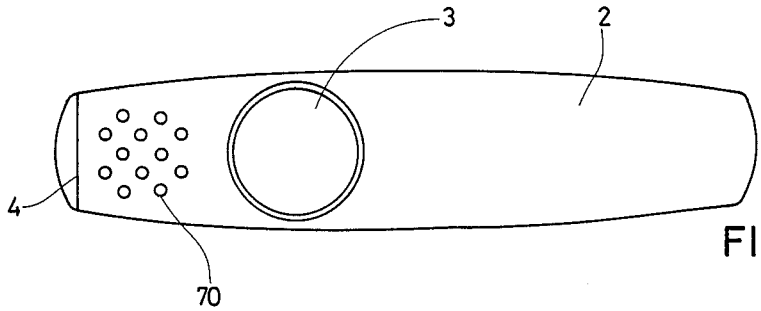
FIGS. 6 and 7 show a plan view from the rear side and a sectional view of an improved electronic grip according to a second embodiment of the present invention, respectively.
Figure 7:
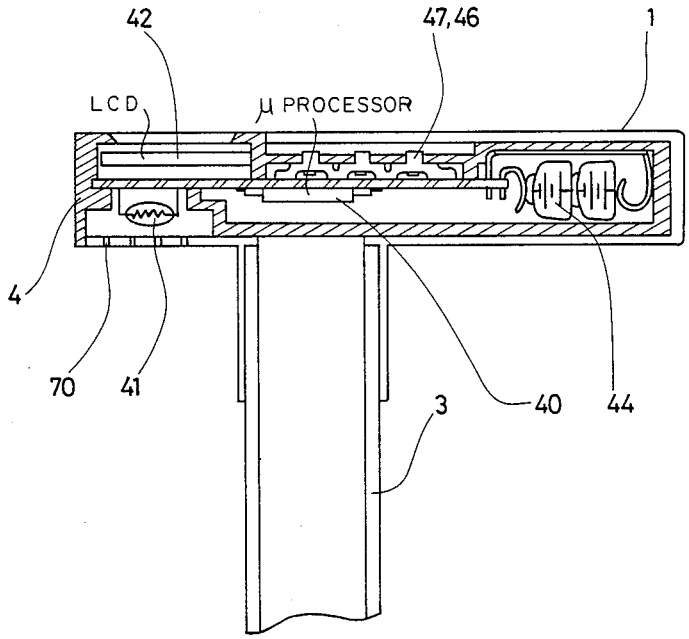

FIGS. 6 and 7 show a plan view from the rear side and a sectional view of an improved electronic grip according to a second embodiment of the present invention, respectively.

A plurality of ventilator holes 70 are provided on the rear surface of the electronic grip 2, and the temperature sensor means 41 is disposed at the position in correspondence with the plurality of ventilator holes 70, so that the influence of heat from the human body or sunshine is reduced and the surrounding temperature is measured correctly and accurately.

Figure 9:
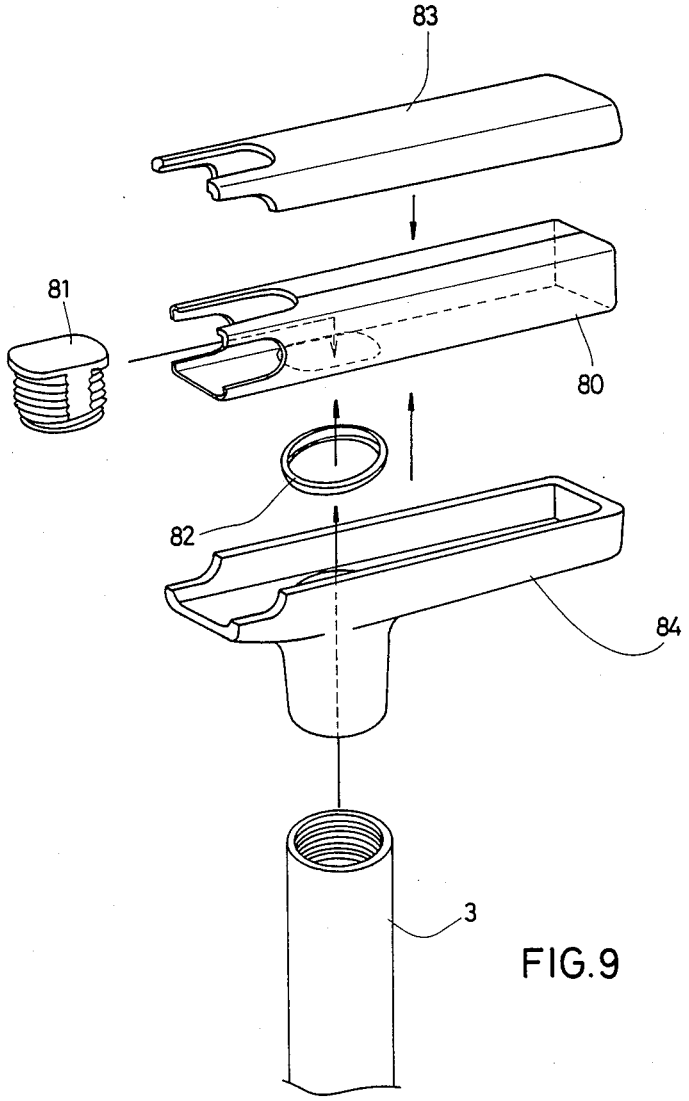

FIGS. 8 and 9 show perspective views of the construction of the grip according to a third embodiment of the present invention.

A function change switch is designated by 85, which is operated to select, for example, a timepiece or a thermometer.

The electronic apparatus 4 is projected as shown in FIG. 8 in response to the actuation of the push button 6. The display 5 is positioned so as to display even when the electronic apparatus is stored in the electronic grip 2. The push button 6 is provided so as to be pressed even when the electronic apparatus 4 is stored in the grip 2. The grip 2 has grooves at the positions corresponding to the display position and the push button position.

In this embodiment, the alarm key 46 is provided on the rear surface of the electronic apparatus 4 and is pressed for announcing an emergency condition of the user when the electronic apparatus 4 is projected. The data set keys 47 are provided on the upper surface of the electronic apparatus 4.

With reference to FIG. 9, an electronic grip 2 storing the electronic apparatus 4 comprises a chassis 80 made of steel, a modified cross-section bolt 81, a ring 82 made of steel, and cabinets 83 and 84 made of plastic resin.

The electronic apparatus 4 is stored into the chassis 80. The modified cross-section bolt 81 connects and fixes the chassis 80 to the stick 3 via the ring 82 and the cabinet 84. The ring 82 fixes the modified cross-section bolt 81 to the chassis 80. The chassis 80 is packaged by the cabinets 83 and 84. Therefore, the chassis 80 is placed between the cabinets 83 and 84. The cabinets 83 and 84 are formed as a grip handled by the user. The cabinet 83 is bonded with the cabinet 84.

In the above construction, the electronic cane 1 becomes hard, and the electronic apparatus 4 is protected from being destroyed because the electronic apparatus 4 is stored into the chassis 80 made of steel.

The electronic apparatus 4 including all operation switch buttons is stored in the grip 2, so that the electronic apparatus 4 is protected from damage and the malfunction of the operation switch buttons is reduced. When the electronic apparatus 4 is projected by pressing the push button 6, the operation switch buttons can be actuated.

Also, the display 5 is provided on a tip end of the upper surface of the grip 2, so that the display 5 is easy to see even when the grip 2 of the cane 1 is handled by the user.

Figure 10:
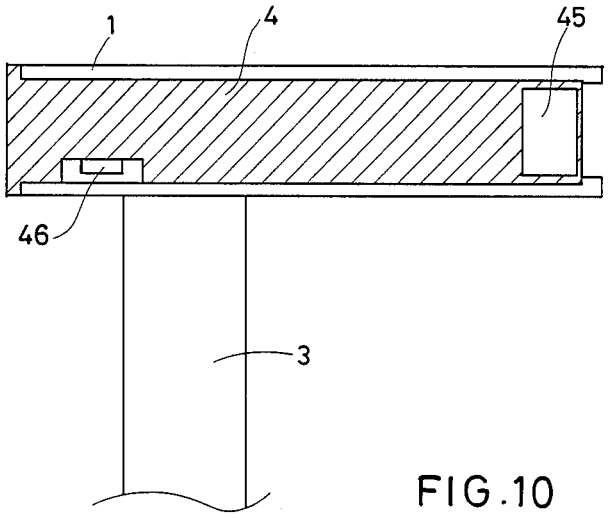
FIGS. 10 and 11 show sectional views of an improved electronic grip according to a fourth embodiment of the present invention.
Figure 11:
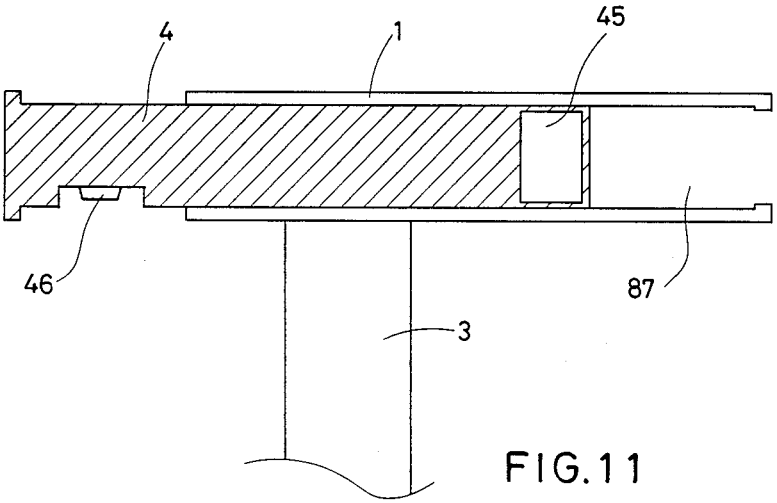

FIGS. 10 and 11 show sectional views of an improved electronic grip according to a fourth embodiment of the present invention.

The speaker 45 is provided at the back position of the electronic apparatus 4, and the back surface of the electronic grip 2 is made open, so that a sound resonance space 87 is formed in the hole when the electronic apparatus 4 is projected from the electronic grip 2. Therefore, the alarm for informing the abnormal condition is larger.

Figure 12:
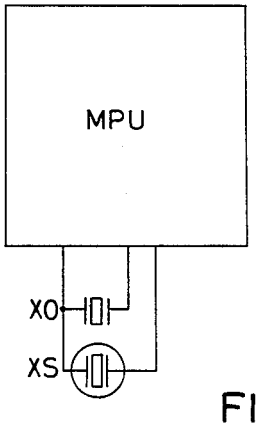
FIG. 12 shows a block diagram of the electronic apparatus stored in the electronic grip according to a fifth embodiment of the present invention where the sensor means is a humidity sensor.

FIG. 12 shows a block diagram of the electronic apparatus stored in the electronic grip according to a fifth embodiment of the present invention when the sensor means 41 is a humidity sensor.

XO designates a general crystal oscillator, and XS designates a crystal oscillator whose resonance frequency is changed in response to the variation of the surrounding humidity.

When the surrounding humidity is measured, the ratio (XS/XO) of the oscillation frequencies (or the oscillation cycles) between the contents of the crystal oscillator XO and those of the crystal oscillator XS is calculated, and the surrounding humidity is calculated by a functional calculation based on the ratio of the oscillation frequencies (the oscillation cycles). The crystal oscillator XS is provided by adding a moisture absorption polyamide to a general crystal oscillator, so that the change of the resonance frequency is measured in response to the change in weight by the moisture absorption.

Figure 13:
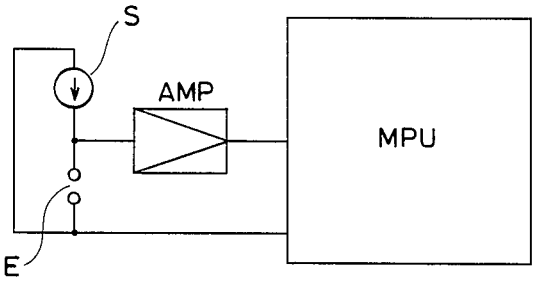
FIG. 13 shows a block diagram of the sensor means in the electronic apparatus of the electronic cane according to a sixth embodiment of the present invention where the sensor means is a pulse sensor.

FIG. 13 shows a block diagram of the sensor means in the electronic apparatus of the electronic cane according to a sixth embodiment of the present invention when the sensor means 41 is a pulse sensor means.

E designates two electrodes provided on the grip 2 of the cane 1, and S designates a power source.

The potential difference between the two electrodes E is changed in response to the pulse of the user when he handles the grip 2. It is believed that the above results from the fact that, as blood flow amounts increase, the electric resistance of the skin of the user decreases. The potential difference is amplified by the amplifier AMP. The output (signal 0 or 1) of the amplifier is applied to the microprocessor MPU. The MPU counts the input signal from the amplifier at a predetermined period, so that the number of the pulse is calculated.

In another measurement method of the pulse, the pulse can be measured according to the change of transmission capacity of infrared rays applied to the user hand.

If a touch (tangibility) sensor is used in the present invention, a sensor means for detecting a vibration is provided at the bottom of the stick 3, and the vibration detected by the sensor means is amplified by the amplifier and the grip of the cane is mechanically vibrated in response to the amplified vibration. Therefore, the presence or absence of the obstruction is detected.

Also, if a moisture sensor is provided at the bottom of the stick 3, a puddle can be detected.

It may be possible that other sensor means such as any blood pressure and any image sensor, and any sensor using supersonic waves and infrared rays can be used in the electronic cane for indicating an abnormal condition or a dangerous condition. For example, by using supersonic waves, the distance, presence or abssence of an obstruction can be detected. By using infrared rays, a man or an animal can be detected.

Figure 14:
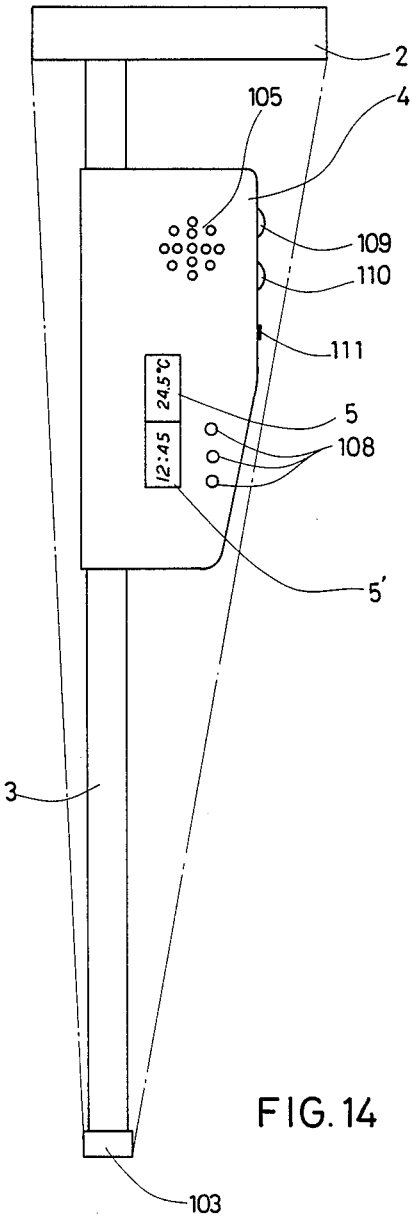
FIGS. 14 and 15 show a plan view and a side view of an electronic cane according to a seventh embodiment of the present invention, respectively.
Figure 15:
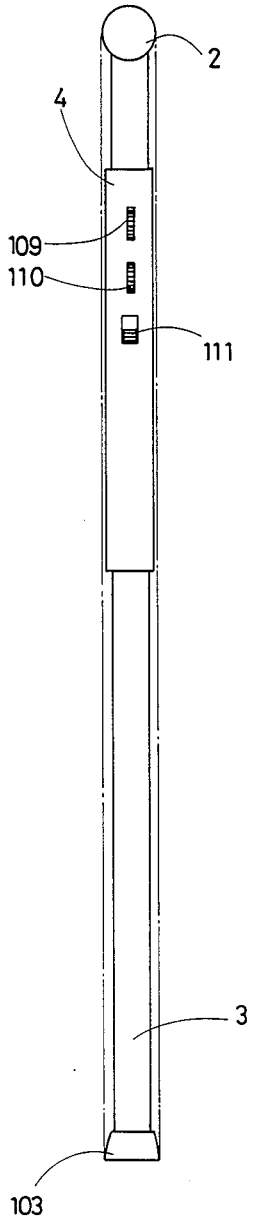

FIGS. 14 and 15 show a plan view and a side view of an electronic cane according to a seventh embodiment of the present invention, respectively.

In this embodiment, the electronic apparatus 4 for informing various information is provided on the stick 3.

The electronic apparatus 4 includes a timepiece, a temperature measurement circuit, and a radio receiving circuit and the like. A speaker for the radio, the timepiece or the temperature circuit is designated by 105, displays for displaying a time from the timepiece, a temperature from the temperature circuit, and a receiving frequency from the radio receiving circuit are designated by 5 and 5', respectively, and a skidproof rubber is designated by 103.

Control keys 108 are operated to correct a time and set a range of a temperature. A dial for setting a radio receiving frequency is designated by 109, and a volume controlling dial is designated by 110, and a power source switch is designated by 111.

The electronic apparatus 4 is disposed inside each straight chain line as shown in FIGS. 14 and 15. Each straight chain line connects each side of the grip 2 with each side of the bottom of the stick 3.

In the above construction, the electronic apparatus is protected from being destroyed by a collision with obstructions or the body of the user.

the invention being thus described, it will be obvious that the same may be varied in many ways. Such variations are not to be regarded as a departure from the spirit and scope of the invention, and all such modifications are intended to be included within the scope of the following claims.

What is claimed is:

1. An electronic cane including a stick comprising:

grip means connected to said stick for sensing and processing information including, sensor means for sensing information related to physical parameters of the surrounding environment and of a user of the cane;

microprocessor means, responsive to the information sensed by said sensor means, for processing said information sensed by said sensor means;

display means for displaying said processsed information;

key input means, operatively connected to said microprocessor means, for inputting data related to maximum and minimum values of said physical parameters to said microprocessor means;

said microprocessor means including means for comparing said sensed information from said sensor means with said maximum and minimum values and for generating alarm signal, and alarm means, operatively connected to said means for comparing for receiving said alarm signal and for indicating that a sensed physical parameter is outside the range defined by said maximum and minimum values in response thereto.

2. The electronic cane of claim 1 wherein said grip means further comprises:

case means for storing said sensor means, said microprocessor means, said display means, said key input means, and said alarm means; and push-button means for retractably projecting said case means from said grip means upon activation by a user.

3. The electronic cane of claim 1, wherein said grip means further comprises:

alarm key means for actuating said alarm means upon activation by a user.

4. The electronic cane of claim 1, wherein said physical parameters are selected from the group consisting of temperature of the environment, humidity of the environment, blood pressure of the user and pulse rate of the user.

5. The electronic cane of claim 1, wherein said alarm means is an audible alarm.

* * * * *